US008925571B2

(12) United States Patent
Li et al.

(10) Patent No.: US 8,925,571 B2
(45) Date of Patent: Jan. 6, 2015

(54) FIXING STRUCTURE OF A PULL-OUT FAUCET

(75) Inventors: Chunhung Li, Taichung (TW); Yongjun Wu, Shen Zen (TW); Weimien Hsu, Taichung (TW); Wanhong Tan, Shen Zen (TW); Qiuyong Li, Shen Zen (TW)

(73) Assignee: Globe Union Industrial Corp., Taichung (TW)

( * ) Notice: Subject to any disclaimer, the term of this patent is extended or adjusted under 35 U.S.C. 154(b) by 313 days.

(21) Appl. No.: 13/595,123

(22) Filed: Aug. 27, 2012

(65) Prior Publication Data

US 2013/0180601 A1 Jul. 18, 2013

(51) Int. Cl.
*E03C 1/042* (2006.01)
*F16K 51/00* (2006.01)

(52) U.S. Cl.
USPC ..... 137/315.12; 137/801; 4/677; 4/695

(58) Field of Classification Search
USPC ..... 137/315.01, 315.12, 625.4, 625.41, 137/801; 4/675–678, 695; 239/447
See application file for complete search history.

(56) References Cited

U.S. PATENT DOCUMENTS

| | | | | |
|---|---|---|---|---|
| 4,848,395 | A | 7/1989 | Krippendorf | |
| 6,123,106 | A * | 9/2000 | Benstead | 137/801 |
| 6,301,728 | B1 * | 10/2001 | Pilatowicz et al. | 4/695 |
| 6,757,921 | B2 | 7/2004 | Esche | |
| 7,748,406 | B2 | 7/2010 | Pilatowicz et al. | |
| 8,528,129 | B2 * | 9/2013 | Li et al. | 4/695 |
| 8,631,816 | B2 * | 1/2014 | Hsu | 137/315.12 |
| 8,763,175 | B2 * | 7/2014 | Li et al. | 4/677 |

* cited by examiner

*Primary Examiner* — Kevin Lee
(74) *Attorney, Agent, or Firm* — Alan Kamrath; Kamrath IP Lawfirm, P.A.

(57) ABSTRACT

A fixing structure of a pull-out faucet is mounted on a platform with a fixing hole and contains a pull-out faucet including a housing, a pull-out spray head, a mixing valve, and a pipe line set; the pipe line set including a plurality of fixedly static pipe lines and a movably dynamic pipe line; a positioning device including a seat and a clamping set; the seat being fixed under the platform by the clamping set and being fixed in the fixing hole to fit with the housing, the seat including a passage set for inserting the pipe line set; wherein the passage set has a first passage for inserting the static pipe lines and a second passage for inserting the dynamic pipe line, and the first passage is spaced apart from the second passage so that the dynamic pipe line is limited in the second passage to move smoothly.

19 Claims, 9 Drawing Sheets

FIXING STRUCTURE OF A PULL-OUT FAUCET

FIELD OF THE INVENTION

The present invention relates to a fixing structure of a pull-out faucet.

BACKGROUND OF THE INVENTION

A conventional faucet for a sink platform in a kitchen is provided with a pull-out spray head to facilitate the wash of pots and plates, and so on, in the sink rather than under the faucet. Because the function of the conventional faucet is well known, further remarks are omitted.

A two handle pull-out faucet disclosed in U.S. Pat. No. 7,748,406 comprises a body for receiving a spray hose, a hot water valve, a cold water valve, a first pipe for flowing cold water, a second pipe for flowing hot water, and a third pipe for flowing the cold water and the hot water, wherein a cold water grip and a hot water grip are used to operate the cold water valve and the hot water valve respectively, so that the cold water from the first pipe and the hot water from the second pipe flow into a water passages of the body, and they are controlled and mixed at a certain quantity and a proportion. The third pipe has a water hammer and couples with the pull-out spray head via the spray hose.

A single handle pull-out faucet disclosed in U.S. Pat. No. 6,757,921 comprises a body having a mixing valve, and a single grip fixed on the body to operate the mixing valve, hence cold water from a cold water pipe and hot water from a hot water pipe flow into the mixing valve and mix together at a certain quantity and a proportion.

The two handle pull-out faucet is merely applicable for a sink platform with three fixing holes rather than a single fixing hole. But the single handle pull-out faucet is suitable for the sink platform with three fixing holes and a single fixing hole. Likewise, the single handle pull-out faucet has a grip to control water flow easily and quickly.

It is to be noted that the single handle pull-out faucet contains a body, and the body has a seat with outer threads to insert into the fixing hole of the water platform, and the seat has a fiber gasket and a metal piece fitted thereon and has a maintaining loop screwed thereon, the maintaining loop is also screwed with a screw bolt which abuts against the metal piece, the seat and the body are fixed on the water sink, so a user has to install the single handle pull-out faucet in a narrow space under the water platform difficultly.

In addition, the third pipe for flowing the cold water and the hot water has a flexible spray hose and a valve outlet pipe, and the spray hose is in connection with the pull-out spray head to receive the water hammer, the valve outlet pipe couples with the mixing valve and the spray hose, such that the pull-out spray head is pulled outwardly and retracted inwardly. Thereby, the seat has to receive the first pipe, the second pipe, the spray hose, and the valve outlet pipe, but a size of the fixing hole is limited, accordingly the first pipe, the second pipe, the spray hose, and the valve outlet pipe are pressed and interfered by one another, then when the pull-out spray head is pulled outwardly, the spray hose is pressed or wound without being pulled or retracted smoothly.

A mixing faucet disclosed in U.S. Pat. No. 4,848,395 is used for a cleaning countertop and contains a housing retained on a bottom end of the cleaning countertop by ways of a claming means and fixed in a fixing hole of the cleaning countertop. To improve a connection of the cleaning countertop, a seat with a passage to receive water pipe lines is secured in the fixing hole, such that the housing is fitted with the seat from a top surface of the cleaning countertop and then is locked at a locking position. Since the housing is fixed from the top surface of the cleaning countertop by ways of the clamping means and the seat, so the user will not install the mixing faucet in a limited space under the cleaning countertop. Nevertheless, such a mixing faucet is not a pull-out faucet, the pull-out spray head, the spray hose, and the valve outlet pipe are not therefore provided in the mixing faucet, hence the unsmooth pulling and retracting of the pull-out spray head will not happen.

The present invention has arisen to mitigate and/or obviate the afore-described disadvantages.

SUMMARY OF THE INVENTION

The primary object of the present invention is to provide a fixing structure of a pull-out faucet which is capable of overcoming the shortcomings of the conventional fixing structure of the pull-out faucet.

To obtain the above objectives, a fixing structure of a pull-out faucet is mounted on a platform with a fixing hole and contains:

a pull-out faucet including a housing, a pull-out spray head, a mixing valve fixed in the housing, and a pipe line set; the pipe line set including a plurality of fixedly static pipe lines connected to the mixing valve and a movably dynamic pipe line connected between one of the plurality of static pipe lines and the pull-out spray head;

a positioning device including a seat and a clamping set; the seat being fixed under the platform by the clamping set and being fixed in the fixing hole of the platform to fit with the housing, the seat including a passage set for inserting the pipe line set; wherein the passage set has a first passage for inserting the plurality of static pipe lines and a second passage for inserting the dynamic pipe line, and the first passage is spaced apart from the second passage so that the dynamic pipe line is limited in the second passage to move smoothly.

Thereby, the pull-out faucet is fixed on the platform conveniently by installing the fixing structure of the pull-out faucet above the platform, so the user can avoid operating the fixing structure of the pull-out faucet under a narrow space of the platform, thus fixing and replacing the pull-out faucet easily and quickly. Furthermore, the first passage and the second passage of the seat are spaced apart from each other to ensure the dynamic pipe (e.g., the spray hose) being limited in the second passage so as to pull outwardly or retract inwardly when the dynamic pipe is moved with the pull-out spray head. Thereby, the spray hose moves smoothly without being interfered by the plurality of static pipe lines. Also, the pull-out spray head allows being smoothly pulled outward and retracts backward.

Moreover, the seat is fixed in the fixing hole of the platform by using the first positioning point, the second positioning point, and the third positioning point, thus positioning the seat accurately. Preferably, the mounting member is removed after the seat is fixed on the platform so that the first passage forms the biggest receiving space to ensure the first passage being located within the fixing hole and to further insert the plurality of static pipe lines. Therefore, if the first positioning point is formed by the seat instead of the resilient leg, the receiving space of the first passage is limited without receiving the plurality of static pipe lines easily.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
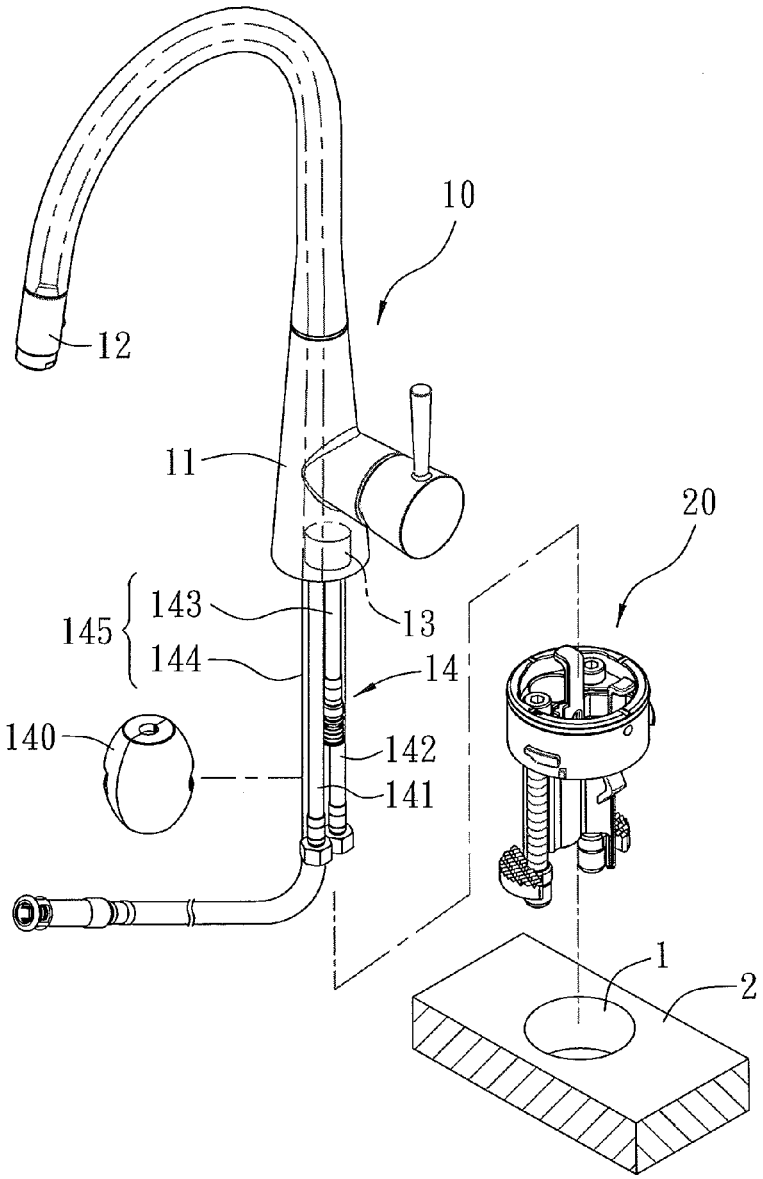
FIG. 1 is a perspective view showing most of the exploded components of a fixing structure of a pull-out faucet according to a preferred embodiment of the present invention, wherein the pull-out faucet is fixed on a platform of a sink.

With reference to FIG. 1, a fixing structure of a pull-out faucet according to a preferred embodiment of the present invention comprises: a pull-out faucet 10 and a positioning device 20, wherein the pull-out faucet 10 is mounted on a platform 2 with a fixing hole 1, the platform 2 is a kitchen cabinet plate, the kitchen cabinet has a sink, and the pull-out faucet 10 is fixed on the platform 2 around the sink.

The pull-out faucet 10 is a single handle pull out faucet and includes a housing 11, a pull-out spray head 12, a mixing valve 13 fixed in the housing 11, and a pipe line set 14; the pipe line set 14 includes a plurality of fixedly static pipe lines connected to the mixing valve 13, a movably dynamic pipe line connected between one of the plurality of static pipe lines and the pull-out spray head 12, and a water hammer 140 disposed on the dynamic pipe line. In this embodiment, the plurality of static pipe lines include a first inlet pipe 141 for flowing cold water, a second inlet pipe 142 for flowing hot water, and a valve outlet pipe 143; and the dynamic pipe line is a spray hose 144 coupled with the pull-out spray head 12, the spray hose 144 is also connected with the valve outlet pipe 143 to form a mixing outlet pipe 145.

Figure 2:
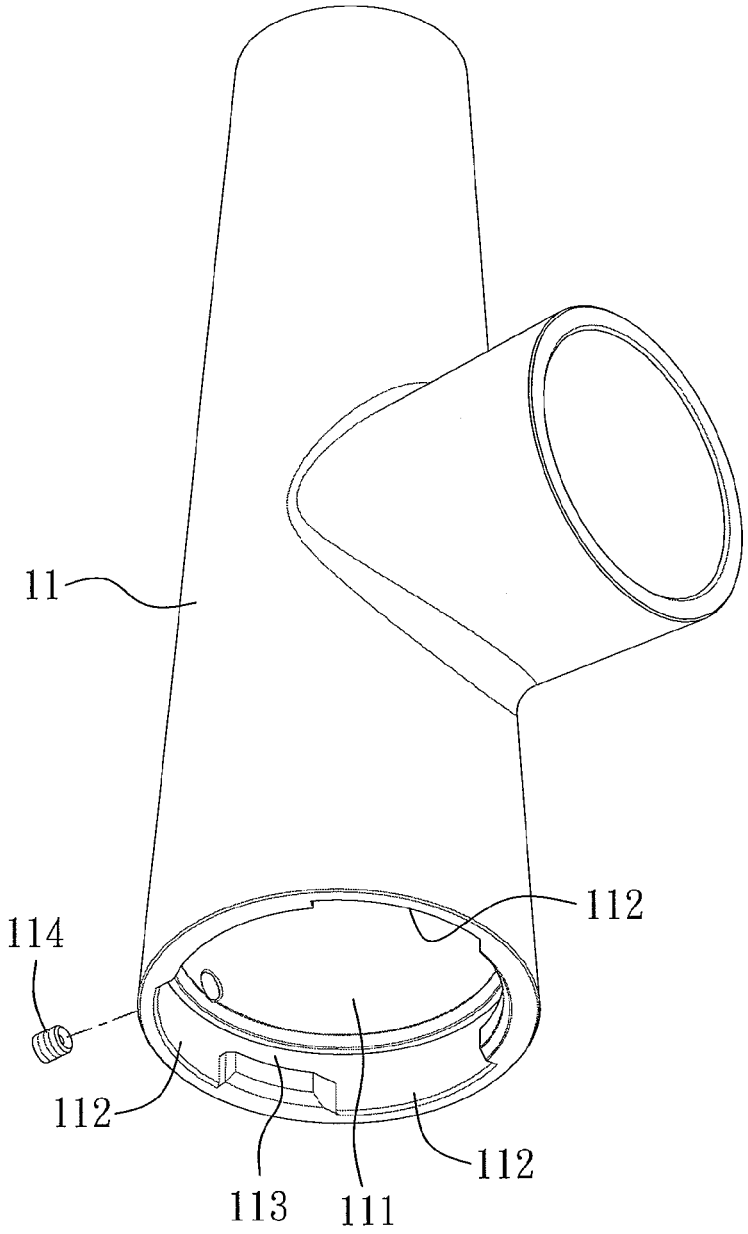
FIG. 2 is a perspective view showing the assembly of a housing of the fixing structure of the pull-out faucet according to the preferred embodiment of the present invention.

Referring further to FIG. 2, the housing 11 includes an opening 111 formed on a bottom end thereof, a plurality of longitudinal grooves 112 defined around an inner peripheral wall thereof and being adjacent to the opening 111, a slot 113 surrounding the inner peripheral wall thereof, and a locking element 114 secured in an outer peripheral wall thereof adjacent to the bottom end of the housing 11, wherein the locking element 114 is a stud bolt.

Figure 3:
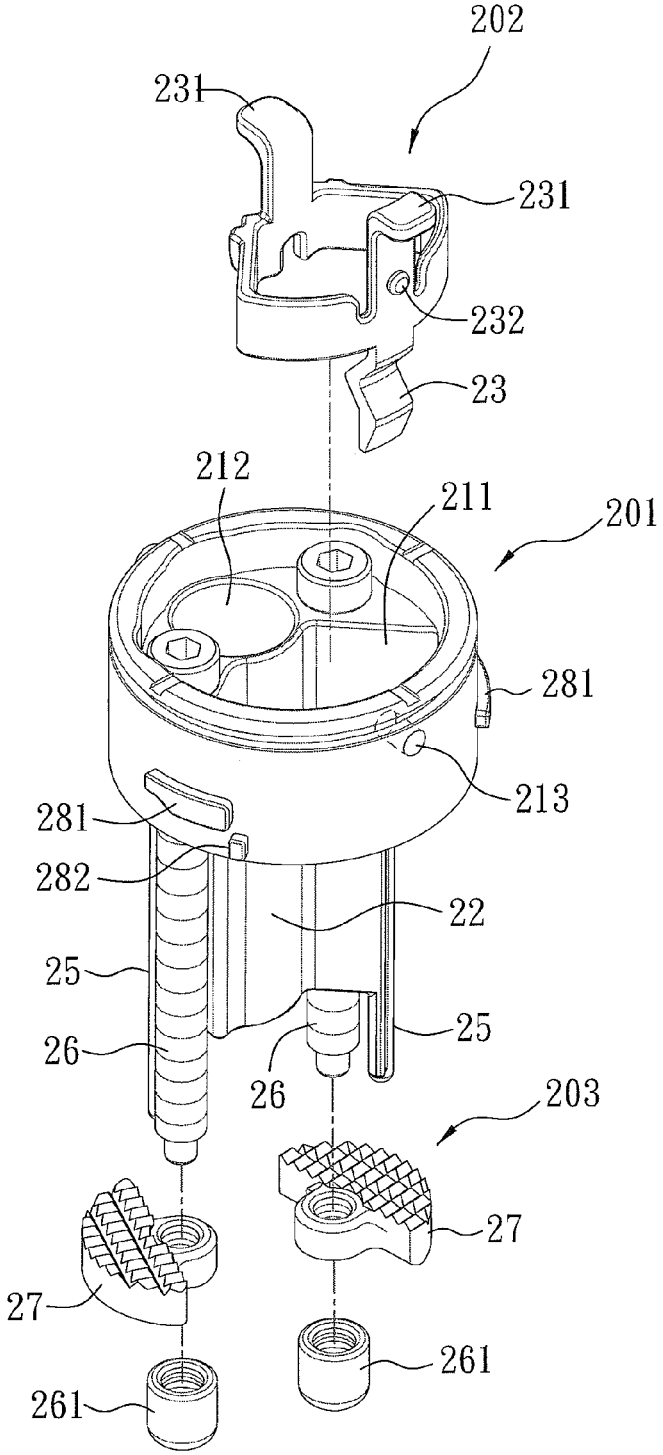
FIG. 3 is a perspective view showing the exploded components of the positioning device of the fixing structure of the pull-out faucet according to the preferred embodiment of the present invention.
Figure 4:
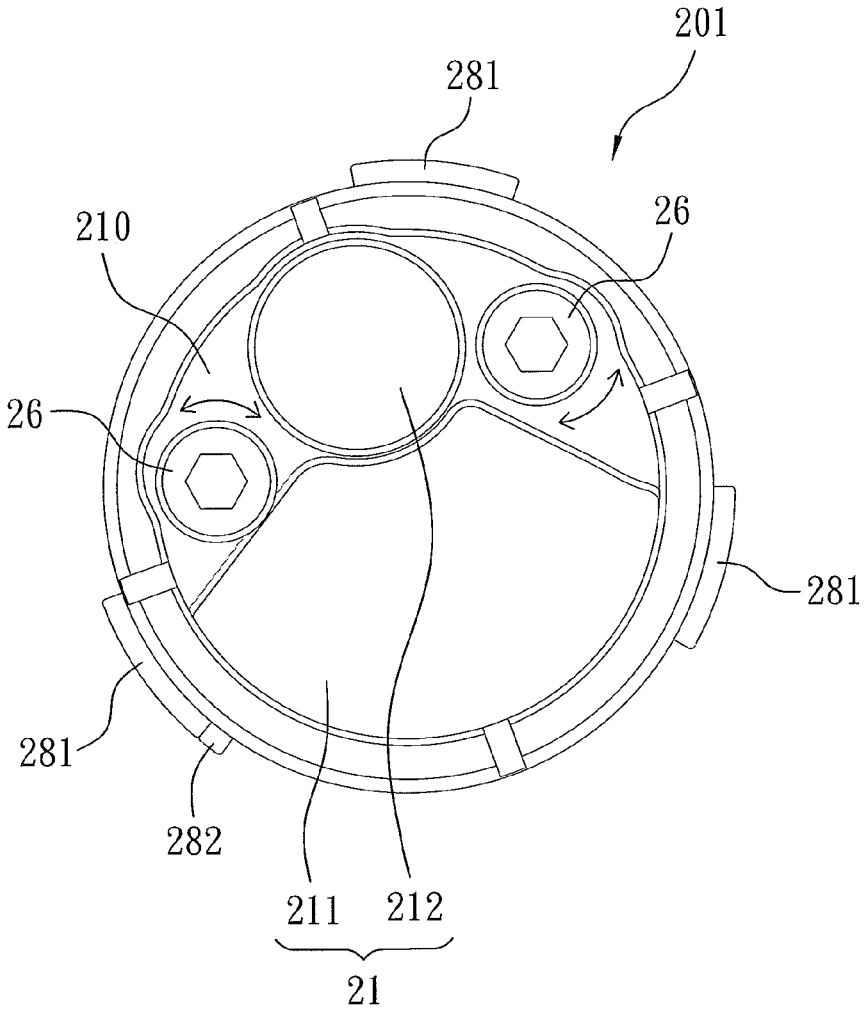
FIG. 4 is a bottom plan view showing the assembly and the operation of a seat of the fixing structure of the pull-out faucet according to the preferred embodiment of the present invention.

As shown in FIG. 3, the positioning device 20 includes a seat 201, a removable mounting member 202, and a clamping set 203. A bottom surface of the seat 201 contacts with a top surface of the platform 2 around the fixing hole 1 and is inserted into the fixing hole 1 of the platform 2 to be further fixed under the platform 2 by the clamping set 203. The seat 201 is covered by the housing 11 and includes a passage set 21 for inserting the pipe line set 14; wherein the passage set 21 has a first passage 211 for inserting the plurality of static pipe lines and a second passage 212 for inserting the dynamic pipe line. As shown in FIG. 4, the first passage 211 is spaced apart from the second passage 212 so that the dynamic pipe line is limited in the second passage 212 to move smoothly.

Figure 5:
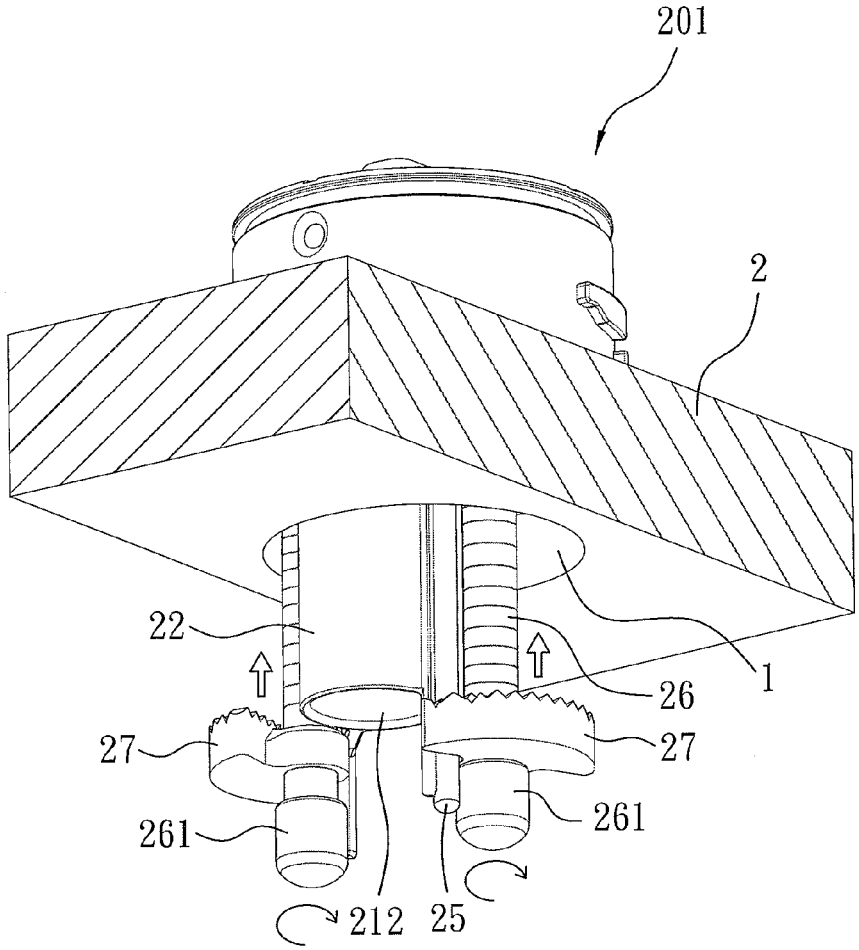
FIG. 5 is a perspective view showing the operation of the positioning device of the fixing structure of the pull-out faucet according to the preferred embodiment of the present invention.

The second passage 212 of the seat 201 is defined by an inner space of a tube 22, and the tube 22 is integrally connected with an inner wall of the seat 201 and downwardly extends out of the fixing hole 1 of the platform 2 as illustrated in FIG. 5 and has a closed peripheral fence to space the second passage 212 apart from the first passage 211, and an exterior of the tube 22 forms a long-distance slidable face so that the dynamic pipe line slides thereon stably and smoothly.

It is to be noted that the first passage 211 allows inserting the plurality of static pipe lines, and the second passage 212 only allows inserting the dynamic pipe line, so a cross-sectional area of the first passage 211 is larger than that of the second passage 212.

Figure 6:
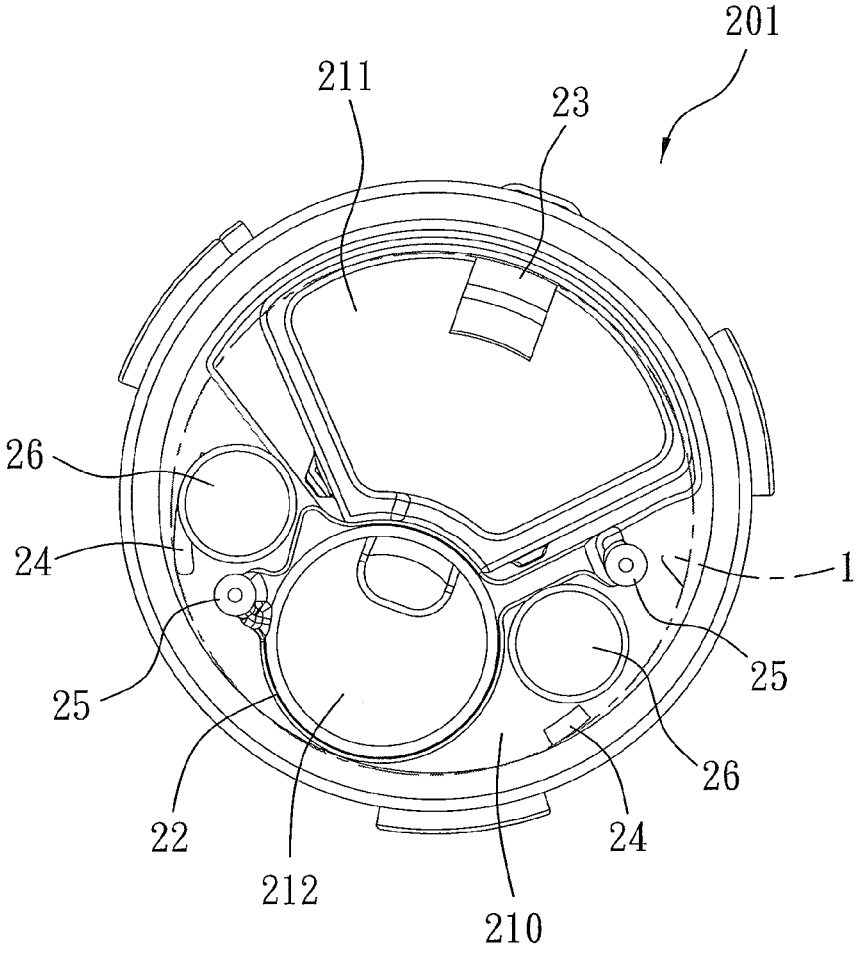
FIG. 6 is a bottom plan view showing the operation of the positioning device of the fixing structure of the pull-out faucet according to the preferred embodiment of the present invention.

The mounting member 202 is retained in the first passage 211 and has a resilient leg 23 extending downwardly therefrom to abut against an inner wall of the fixing hole 1 where a first positioning point is formed as shown in FIG. 6.

The seat 201 has two protrusions 24 arranged on a peripheral area of the bottom surface thereof beyond the passage set 21, and two outer walls of the two protrusions 24 are biased against the inner wall of the fixing hole 1 to form a second positioning point and a third positioning point, hence the first positioning point, the second positioning point, and the third positioning point facilitate a quick positioning. For example, the seat 201 is fixed in the fixing hole 1 of the platform 2 quickly and precisely to prevent the seat 201 from deviation, and the mounting member 202 is removed after the seat 201 is secured on the platform 2 so that the first passage 211 forms a biggest receiving space to insert the plurality of static pipe lines as illustrated in FIG. 4 and to ensure the first passage 211 being located within the fixing hole 1.

It is to be noted that due to the mounting member 202 is removed after the seat 201 is retained, so two grips 231 are provided on a top rim of the mounting member 202 for being held by a user as illustrated in FIG. 3, such that the mounting member 202 is pressed downwardly or pulled upwardly. Besides, one of the two grips 231 relative to an inner wall of the first passage 211 is flexible and has a securing boss 232 disposed thereon, and the first passage 211 of the seat 201 has a notch 213 defined therein to retain with the securing boss 232, thus engaging the mounting member 202 with the seat 201 quickly and precisely.

The seat 201 has two limiting posts 25 and two rotary screws 26, all of which are integrally connected in a surrounding zone 210 of an interior of the seat 201 beyond the passage set 21 and downwardly extend out of the fixing hole 1 as shown in FIG. 5.

The clamping set 203 includes two retaining blocks 27 screwed with the two rotary screws 26, so when the two rotary screws 26 are rotated, the two retaining blocks 27 are limited by the two limiting posts 25 to move upwardly and to retain on a bottom surface of the platform 2 as shown in FIG. 5, such that the seat 201 is fixed in the fixing hole 1 of the platform 2.

The two limiting posts 25 integrally connect with a peripheral wall of the tube 22 and the surrounding zone 210 of the interior of the seat 201 beyond the passage set 21, such that a structural strength of the two limiting posts 25 is enhanced to prevent from a deformation when the two limiting posts 25 are acted by a lateral force of the two retaining blocks 27. In addition, the two limiting posts 25 and the seat 201 are integrally formed from plastic material or metal material to lower assembly and material costs. Of course, the two limiting posts 25 allows selectively connecting with the peripheral wall of the tube 22 or the surrounding zone 210 to obtain above-mentioned effects as well.

Each rotary screw 26 further includes a defining sleeve 261 screwed on a bottom end thereof to limit each retaining block 27 to move downwardly, thus preventing the each retaining block 27 from disengagement from the each rotary screw 26. To avoid the defining sleeve 261 disengagement, an adhesive is applied between the bottom end of the each rotary screw 26 and the defining sleeve 261 so that the defining sleeve 261 is adhered on the each rotary screw 26.

Referring further to FIGS. 3 and 4, the seat 201 further includes a plurality of sliding projections 281 fixed on an outer wall thereof and a stop tab 282 adjacent to one of the plurality of sliding projections 281, such that after the seat 201 is fixed on the platform 2, the housing 11 is fitted with the seat 201 by using the opening 111, wherein the seat 201 slides into the plurality of longitudinal grooves 112 of the housing 11 by ways of the plurality of sliding projections 281 and rotates into the slot 113 so that the housing 11 is limited at an axial position, and the stop tab 282 abuts against one of the plurality of longitudinal grooves 112 so that the housing 11 is limited at a position in a circumferential direction, thereafter the housing 11 is locked on the seat 201 by means of the locking element 114 of the housing 11.

Accordingly, a connecting method of the fixing structure of the pull-out faucet is briefly described as follows:

Firstly, the two retaining blocks 27 of the clamping set 203 is rotated adjustably so that the tube 22, the two limiting posts 25, the two rotary screws 26, and the two retaining blocks 27 of the seat 201 insert through the fixing hole 1 of the platform 2 until the seat 201 of the positioning device 20 contacts the top surface of the platform 2 around the fixing hole 1, in the meantime, the seat 201 abuts against the platform 2 by using the first positioning point, the second positioning point, and the third positioning point, thus positioning the seat 201 in the fixing hole 1 quickly and precisely.

Then, the two rotary screws 26 are rotated by a tool so that the two retaining blocks 27 are retained on the bottom surface of the platform 2, such that the seat 201 is fixed on the platform 2.

Figure 7:
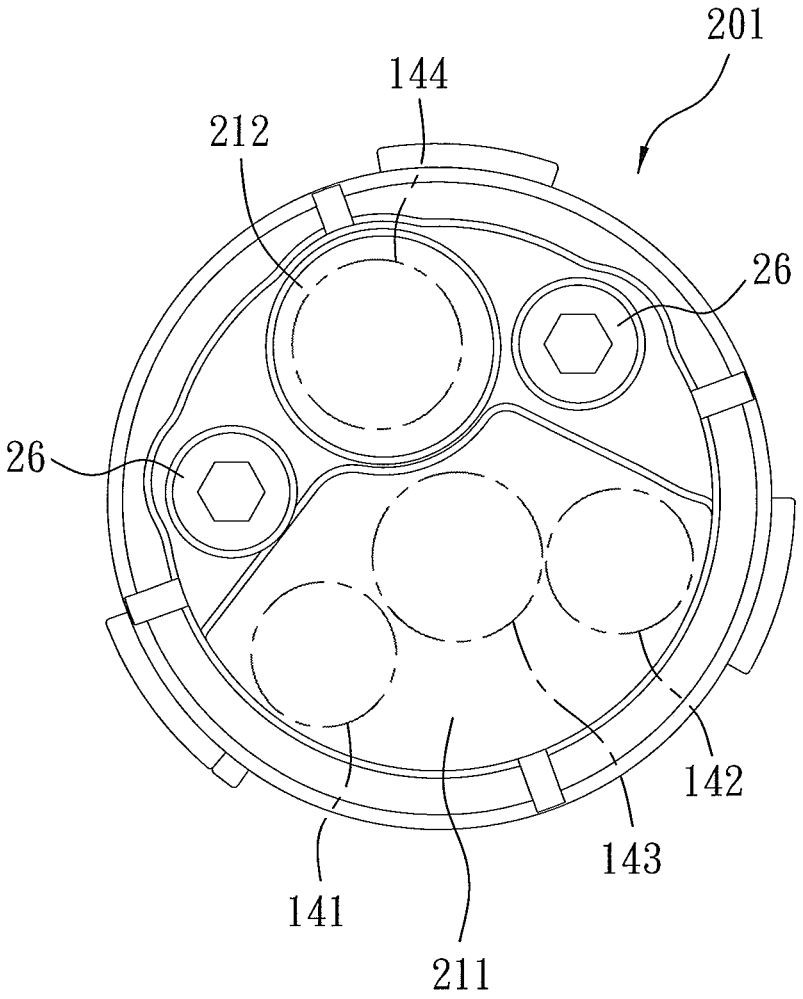
FIG. 7 is a plan view showing the operation of plural static pipe lines and a dynamic pipe line of the fixing structure of the pull-out faucet according to the preferred embodiment of the present invention.
Figure 8:
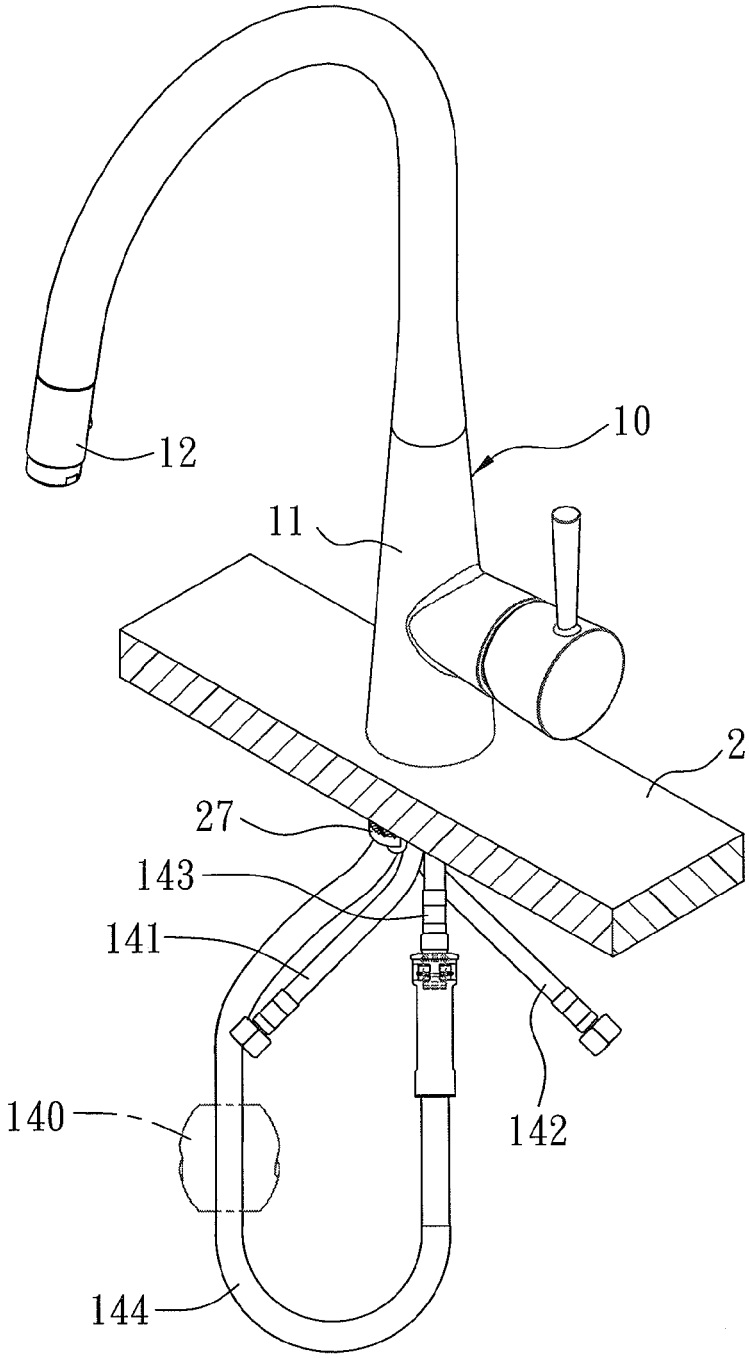
FIG. 8 is a perspective view showing the application of the pull-out faucet according to the preferred embodiment of the present invention.

Thereafter, the movably dynamic pipe line of the pull-out faucet 10, i.e., the pray hose 144, is inserted through the second passage 212 as illustrated in FIG. 7, and then the plurality of static pipe lines (i.e., the first inlet pipe 141, the second inlet pipe 142, and the valve outlet pipe 143) are inserted through the first passage 211, the plurality of longitudinal grooves 112 of the housing 11 are fitted with the plurality of sliding projections 281 of the seat 201, and the housing 11 is rotated toward a predetermined direction until the stop tab 282 of the seat 201 contacts with one of the plurality of longitudinal grooves 112, then the housing 11 is locked on the seat 201 by ways of the locking element 114 as shown in FIG. 8, thereby finishing the assembly of the pull-out faucet 10.

Figure 9:
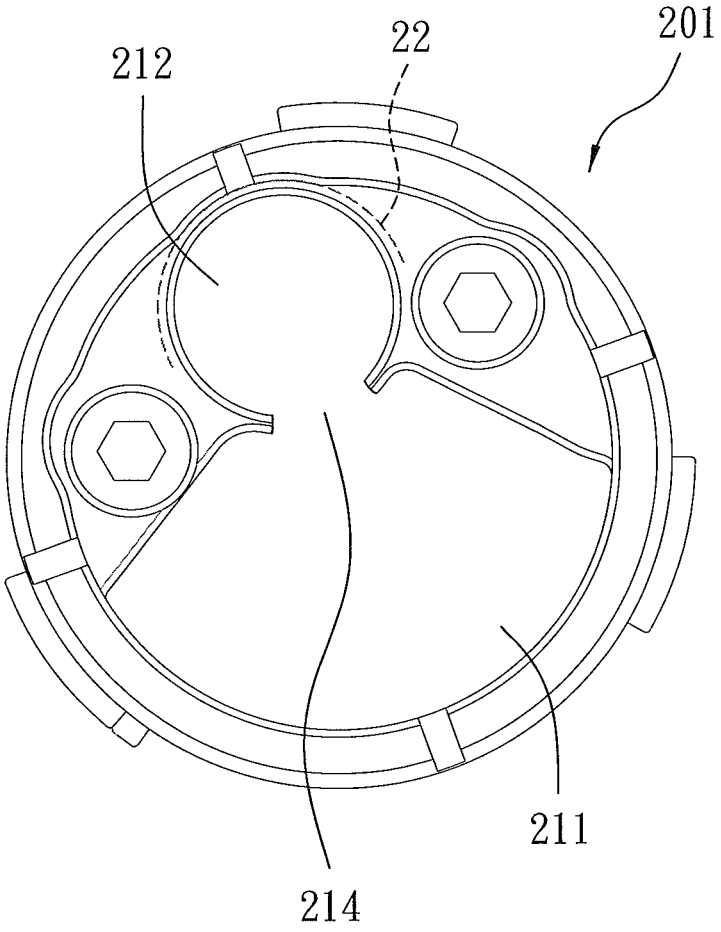
FIG. 9 is a plan view of a first passage, a second passage, and a gap of the fixing structure of the pull-out faucet according to the preferred embodiment of the present invention.

As shown in FIG. 9, the tube 22 of the seat 20 allows being designed to have a semi-closed peripheral fence so as to space the second passage 212 apart from the first passage 211 as well, and on a spacing portion of the second passage 212 and the first passage 211 is defined a gap 214 which communicates with the first passage 211 and the second passage 212, wherein a maximum width of the gap 214 is less than a diameter of the dynamic pipe line so as to stop the dynamic pipe line entering into the first passage 211 via the gap 214 and to limit the dynamic pipe line in the second passage 212, hence the dynamic pipe line moves in the second passage 212 smoothly.

Thereby, the pull-out faucet is fixed on the platform 2 conveniently by installing the fixing structure of the pull-out faucet above the platform 2, so the user can avoid operating the fixing structure of the pull-out faucet under a narrow space of the platform, thus fixing and replacing the pull-out faucet easily and quickly. Furthermore, the first passage 211 and the second passage 212 of the seat 201 are spaced apart from each other to ensure the dynamic pipe (e.g., the spray hose 144) being limited in the second passage 212 so as to pull outwardly or retract inwardly when the dynamic pipe is moved with the pull-out spray head 12. Thereby, the spray hose 144 moves smoothly without being interfered by the plurality of static pipe lines. Also, the pull-out spray head 12 allows being smoothly pulled outward and retracts backward.

Moreover, the seat 201 is fixed in the fixing hole 1 of the platform 2 by using the first positioning point, the second positioning point, and the third positioning point, thus positioning the seat 201 accurately. Preferably, the mounting member 202 is removed after the seat 201 is fixed on the platform 2 so that the first passage 211 forms the biggest receiving space to ensure the first passage 211 being located within the fixing hole 1 and to further insert the plurality of static pipe lines. Therefore, if the first positioning point is formed by the seat 201 instead of the resilient leg 23, the receiving space of the first passage 211 is limited without receiving the plurality of static pipe lines easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fixing structure of a pull-out faucet being mounted on a platform with a fixing hole and comprising:

a pull-out faucet including a housing, a pull-out spray head, a mixing valve fixed in the housing, and a pipe line set; the pipe line set including a plurality of fixedly static pipe lines connected to the mixing valve and a movably dynamic pipe line connected between one of the plurality of static pipe lines and the pull-out spray head;

a positioning device including a seat and a clamping set; the seat being fixed under the platform by the clamping set and being fixed in the fixing hole of the platform to fit with the housing, the seat including a passage set for inserting the pipe line set; wherein the passage set has a first passage for inserting the plurality of static pipe lines and a second passage for inserting the dynamic pipe line, and the first passage is spaced apart from the second passage so that the dynamic pipe line is limited in the second passage to move smoothly.

2. The fixing structure of the pull-out faucet as claimed in claim 1, wherein the second passage of the seat is defined by an inner space of a tube, and the tube is integrally connected with an inner wall of the seat.

3. The fixing structure of the pull-out faucet as claimed in claim 2, wherein the tube has a closed peripheral fence to space the second passage apart from the first passage.

4. The fixing structure of the pull-out faucet as claimed in claim 2, wherein the tube has a semi-closed peripheral fence so as to space the second passage apart from the first passage, and on a spacing portion of the second passage and the first passage is defined a gap which communicates with the first passage and the second passage, wherein a maximum width of the gap is less than a diameter of the dynamic pipe line so as to stop the dynamic pipe line entering into the first passage via the gap.

5. The fixing structure of the pull-out faucet as claimed in claim 2, wherein the tube downwardly extends out of the fixing hole of the platform.

6. The fixing structure of the pull-out faucet as claimed in claim 1, wherein a cross-sectional area of the first passage is larger than that of the second passage.

7. The fixing structure of the pull-out faucet as claimed in claim 1, wherein the plurality of static pipe lines include a first inlet pipe for flowing cold water, a second inlet pipe for flowing hot water, and a valve outlet pipe; and the dynamic pipe line is a spray hose coupled with the pull-out spray head, the spray hose is also connected with the valve outlet pipe to form a mixing outlet pipe.

8. The fixing structure of the pull-out faucet as claimed in claim 7, wherein the pipe line set further includes a water hammer disposed on the spray hose.

9. The fixing structure of the pull-out faucet as claimed in claim 1, wherein the positioning device further includes a removable mounting member retained in the first passage and has a resilient leg extending downwardly from the mounting member to abut against an inner wall of the fixing hole where a first positioning point is formed; the seat has two protrusions arranged on a peripheral area of the bottom surface thereof beyond the passage set, and two outer walls of the two protrusions are biased against the inner wall of the fixing hole to form a second positioning point and a third positioning point, the seat is fixed in the fixing hole of the platform by using the first positioning point, the second positioning point, and the third positioning point; and the mounting member is removed after the seat is secured on the platform.

10. The fixing structure of the pull-out faucet as claimed in claim 9, wherein the mounting member further includes two grips provided on a top rim thereof for being held by a user, and one of the two grips relative to an inner wall of the first passage has a securing boss disposed thereon; and the first passage of the seat has a notch defined therein to retain with the securing boss.

11. The fixing structure of the pull-out faucet as claimed in claim 2, wherein the seat has two limiting posts and two rotary screws, all of which downwardly extend out of the fixing hole; the clamping set includes two retaining blocks screwed with the two rotary screws, so when the two rotary screws are rotated, the two retaining blocks are limited by the two limiting posts to move upwardly and to retain on a bottom surface of the platform, such that the seat is fixed in the fixing hole of the platform.

12. The fixing structure of the pull-out faucet as claimed in claim 11, wherein the two limiting posts and the two rotary screws are integrally connected in a surrounding zone of an interior of the seat beyond the passage set.

13. The fixing structure of the pull-out faucet as claimed in claim 11, wherein the two limiting posts integrally connect with a peripheral wall of the tube.

14. The fixing structure of the pull-out faucet as claimed in claim 11, wherein the two limiting posts are integrally connected in a surrounding zone of an interior of the seat beyond the passage set.

15. The fixing structure of the pull-out faucet as claimed in claim 11, wherein each rotary screw includes a defining sleeve screwed on a bottom end thereof to limit each retaining block to move downwardly, thus preventing the each retaining block from disengagement from the each rotary screw.

16. The fixing structure of the pull-out faucet as claimed in claim 15, wherein an adhesive is applied between the bottom end of the each rotary screw and the defining sleeve so that the defining sleeve is adhered on the each rotary screw.

17. The fixing structure of the pull-out faucet as claimed in claim 1, wherein the seat has two limiting posts and two rotary screws, all of which downwardly extend out of the fixing hole; the clamping set includes two retaining blocks screwed with the two rotary screws, so when the two rotary screws are rotated, the two retaining blocks are limited by the two limiting posts to move upwardly and to retain on a bottom surface of the platform, such that the seat is fixed in the fixing hole of the platform.

18. The fixing structure of the pull-out faucet as claimed in claim 1, wherein the seat further includes a plurality of sliding projections fixed on an outer wall thereof and a stop tab adjacent to one of the plurality of sliding projections, the housing includes an opening formed on a bottom end thereof, a plurality of longitudinal grooves defined around an inner peripheral wall thereof and being adjacent to the opening, and a slot; the housing is fitted with the seat by using the opening, wherein the seat slides into the plurality of longitudinal grooves of the housing by ways of the plurality of sliding projections and rotates into the slot so that the housing is limited at an axial position, and the stop tab abuts against one of the plurality of longitudinal grooves so that the housing is limited at a position in a circumferential direction.

19. The fixing structure of the pull-out faucet as claimed in claim 1, wherein the housing includes a locking element secured in an outer peripheral wall thereof adjacent to the bottom end of the housing so that the housing is locked on the seat.

* * * * *